United States Patent [19]

Schuler

[11] Patent Number: 4,664,527

[45] Date of Patent: May 12, 1987

[54] FEED MIXING DEVICE

[75] Inventor: Dorland Schuler, Griswold, Iowa

[73] Assignee: Schuler Mfg. & Equip. Co., Inc., Griswold, Iowa

[21] Appl. No.: 745,947

[22] Filed: Jun. 18, 1985

[51] Int. Cl.[4] ..... B01F 9/00

[52] U.S. Cl. ..... 366/141; 366/186; 366/228; 366/233; 366/603

[58] Field of Search ..... 366/186, 187, 141, 603, 366/50-58, 220, 222, 224, 225, 228, 233, 236, 156, 157, 25-28, 230

[56] References Cited

U.S. PATENT DOCUMENTS

| | | | |
|---|---|---|---|
| 1,048,763 | 12/1912 | Tiedtke | 366/220 X |
| 1,328,119 | 1/1920 | Brayman | 366/220 |
| 3,429,559 | 2/1969 | Dreher et al. | 366/233 |
| 4,435,081 | 3/1984 | Del Fabbro | 366/141 X |
| 4,444,509 | 4/1984 | Steiner et al. | 366/186 X |
| 4,474,478 | 10/1984 | DeLong | 366/222 |
| 4,500,209 | 2/1985 | Steiner et al. | 366/50 X |

*Primary Examiner*—Timothy F. Simone

*Attorney, Agent, or Firm*—Zarley, McKee, Thomte, Voorhees & Sease

[57] ABSTRACT

The feed mixing device of the present invention includes a sub-frame, a frame suspended on the sub-frame, and a polygonally-shaped drum rotatably mounted on the frame. A drive system is provided for rotating the drum and an auger assembly axially mounted within the drum. A hopper introduces feed into the drum while an adjustable discharge opening adjacent the end of the auger permits selective removal of feed from the drum. A plurality of rows of elongated mixing paddles are secured to the interior of the side wall of the drum such that the longitudinal axis of the paddles are angularly disposed with respect to the axis of rotation of the drum. The paddles within each row are staggered with respect to the paddles in adjacent rows. Convex, channel-shaped scoop blades are mounted to the rear wall of the drum and carry mixed feed to the auger as the drum rotates. A strain gauge is operatively connected to the suspended frame for sensing the displacement of the frame in response to loading of the drum. A readout meter converts the frame displacement sensed by the strain gauge into a force corresponding to the weight of the feed within the drum.

22 Claims, 10 Drawing Figures

FEED MIXING DEVICE

BACKGROUND OF THE INVENTION

It is often desirable to mix various livestock feed components together to produce a substantially uniform feed mixture for the livestock. For example, such a mixture may include combinations of straw, hay, grain and vitamins. Rotary-type tumblers are well known for such mixing purposes. Such tumblers generally include a rotatable cylindrical drum mounted on a framework and having an inlet hopper for introducing grain into the drum. As the drum is rotated, the feed components are mixed by mixing paddles mounted within the drum and then conveyed by an axially positioned auger to a discharge opening.

Such conventional feed mixing tumblers are unsatisfactory for several reasons. First, there is a tendency for the feed within the drum to slide down the smooth side wall thereof and remain in the lowermost portion of the drum and thus not be thoroughly mixed. Also, the feed tends to move too rapidly from the inlet end to the rearward end of the drum without complete mixing due to the inclination of the drum. Furthermore, it is difficult to carry the mixed feed from the lowermost part of the drum after it has been mixed to the auger for conveyance to the discharge opening. Finally, it is desirable to know the quantity or weight of feed within the mixing device.

Therefore, a primary objective of the present invention is the provision of an improved feed mixing device which provides complete and efficient mixing of feed components.

Another objective of the present invention is the provision of a feed mixing device having a rotatable drum with a polygonal side wall.

A further objective of the present invention is the provision of a feed mixing device having a plurality of rows of mixing paddles secured to the interior of the side wall of the drum for mixing and conveying the feed rearwardly as the drum rotates.

Still another objective of the present invention is the provision of a feed mixing device having improved scoop blades at their rearward end of the drum for carrying the mixed feed to the discharge auger.

A further objective of the present invention is the provision of a feed mixing device having a scale thereon for weighing the amount of feed contained within the device.

A further objective of the present invention is the provision of a feed mixing device which is economical to manufacture, and durable and efficient in use.

SUMMARY OF THE INVENTION

The feed mixing device of the present invention generally includes a frame suspended from a sub-frame and upon which a substantially cylindrical drum is rotatably mounted. A drive motor mounted on the frame rotates the drum about its longitudinal axis through a plurality of interconnected gear and pulley assemblies. An inlet hopper is provided on one end of the drum for introducing feed to be mixed into the drum and a discharge opening is provided for removing mixed feed therefrom.

The drum has opposite ends and a polygonally shaped side wall. A plurality of rows of mixing paddles are secured to the interior of the side wall such that the longitudinal axis of each paddle is angularly disposed with respect to the axis of rotation of the drum. The paddles within each row are staggered with respect to the paddles in adjacent rows. Scoop blades are provided at the rearward end of the drum for carrying the mixed feed to an axially disposed auger which conveys the mixed feed to the discharge opening. An adjustable door is provided over the discharge opening for selective release of mixed feed therefrom.

The frame is suspended from the sub-frame such that the introduction of feed into the drum causes a portion of the sub-frame to be displaced. A strain gauge senses such displacement of the sub-frame portion and is operatively connected to a readout display such that the weight of the feed within the drum can be ascertained.

DETAILED DESCRIPTION OF THE DRAWINGS

Figure 1:
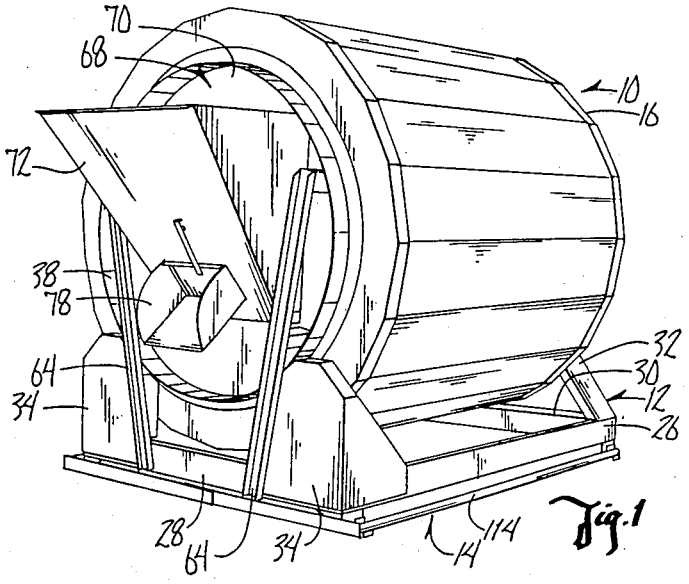
FIG. 1 is a perspective view of the feed mixing device of the present invention.

In the drawings, the feed mixing device of the present invention is generally designated by the reference numeral 10. Basically, device 10 includes a frame 12 suspended on a sub-frame 14 and a substantially cylindrical drum 16 rotatably mounted upon frame 12. Drum 16 has a forward end 18, a rearward end 20, and a side wall 22 comprised of a plurality of wall panels 24 which are interconnected such that side wall 22 is polygonally shaped in cross section. Preferably, drum 16 is disposed such that the axis of rotation is horizontally oriented.

Figure 2:
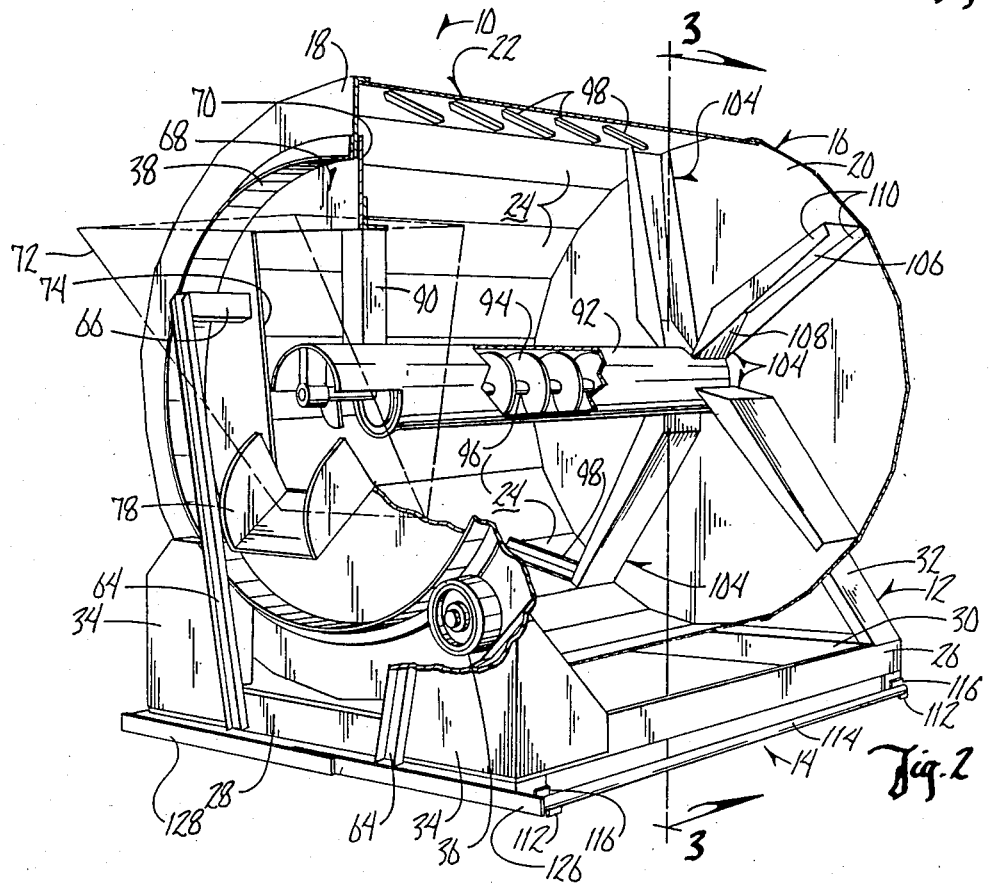
FIG. 2 is a view similar to FIG. 1 with portions of the device removed to show the internal structure of the device.

Frame 12 includes opposite side frame members 26, a front frame member 28, and a rear frame member 30. Drum 16 is rotatably supported on frame 12 in any convenient manner. For example, a pair of support arms 32 extend upwardly from rearward frame member 30 to rotatably support the rear end of drum 16. Forward frame member 28 includes a pair of trunnion wheel support members 34 for rotatably supporting a pair of trunnion wheels 36 (only one of which is shown) which in turn engage an annular ring 38 secured to forward end wall 18 of drum 16 for rotatable support thereof, as seen in FIG. 2.

Figure 5:
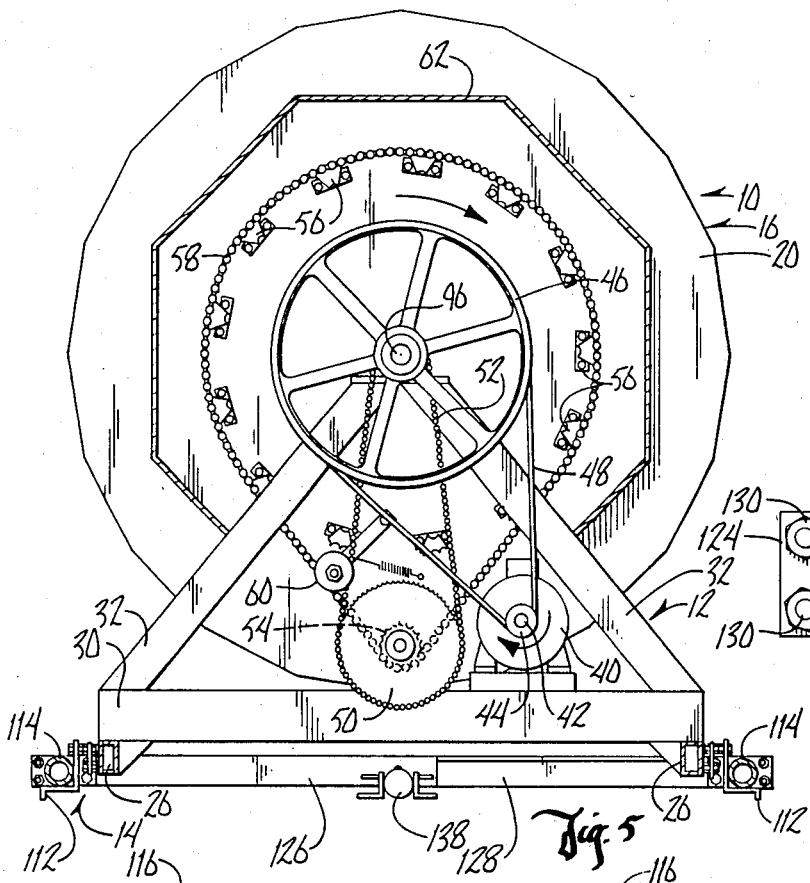
FIG. 5 is a view taken along lines 5—5 of FIG. 4.

The drive system of device 10 is shown in FIG. 5 and includes a motor 40 having a drive shaft 42 with a pulley 44 mounted thereon. A large pulley 46 is rotatably supported by rear support arms 32 and a pulley belt 48 is trained about pulleys 44 and 46. A first gear (not shown) is axially aligned with large pulley 46 and is interconnected to a second gear 50 by a first roller chain 52. A third gear 54 is secured adjacent second gear 50 for rotation therewith and is interconnected to a plurality of gear elements 56 mounted on rearward end wall 20 of drum 16 by a second roller chain 58. Thus, when motor 40 is actuated, drum 16 rotates about its longitudinal axis through the action of the interconnecting pulleys, pulley belts, gears, and roller chains. A spring actuated tension member 60 is provided to maintain proper tension on roller chain 52. A housing 62 is provided over the drive assembly of device 10 to protect the assembly from the elements.

It is understood that the precise components and structure which are provided to impart rotation to drum 16 can be varied without departing from the scope of the present invention.

A pair of forward support arms 64 extend upwardly from forward frame member 28 and have an upper portion 66 extending through an opening 68 in forward end wall 18 of drum 16 so as to support a stationary plate 70 in a close covering relation to opening 68. A hopper 72 is connected to plate 70 such that feed can be introduced into the interior of drum 16 through an access opening 74 in plate 70.

Figure 10:
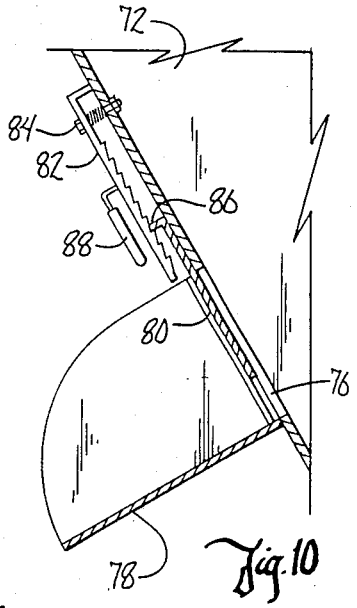
FIG. 10 is a partial sectional side elevation view showing the discharge opening of the device.

The lower portion of hopper 72 includes a discharge opening 76 to which a discharge chute 78 is attached, as best seen in FIG. 10. A door 80 is selectively movable to close discharge opening 76 to the desired extent. A flexible notched door retainer 82 is attached to hopper 72 by bolt means 84 such that one of the notches thereon engages a lip 86 on door 80 to hold the door in position over opening 76. A handle 88 is provided on door retainer 82 for easy adjustment of door 80.

Figure 4:
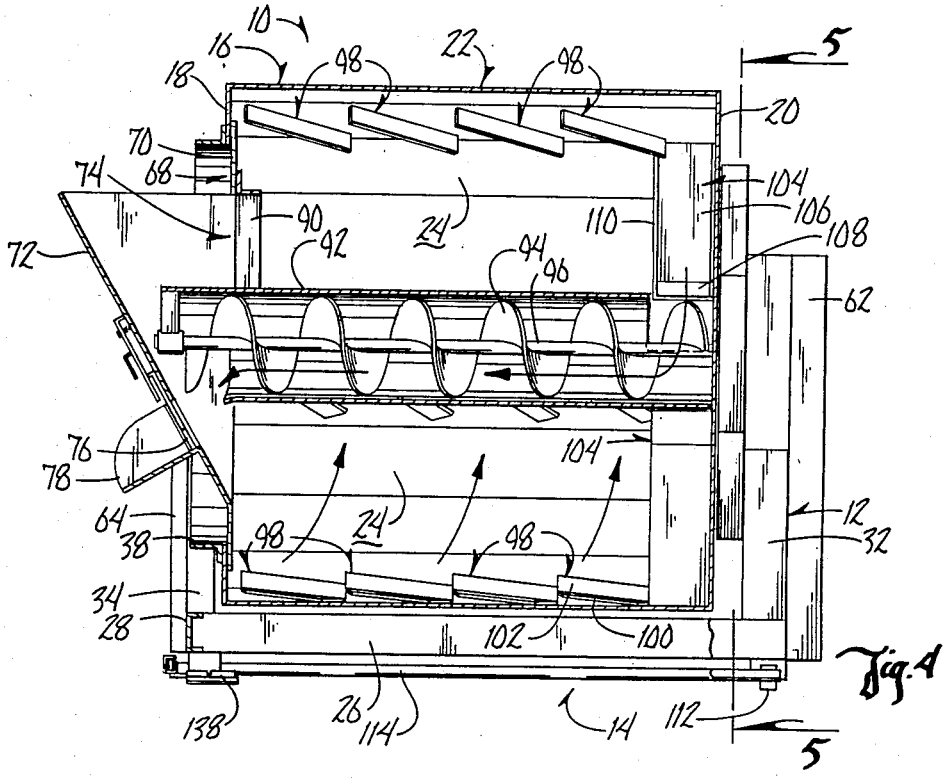
FIG. 4 is a side sectional elevation view.

Secured to plate 70 on the interior of drum 16 is an auger support arm 90 which supports the forward end of an auger housing 92 in which an auger 94 is operatively mounted for conveying mixed feed from the rear of drum 16 to discharge opening 76 adjacent the front end of the drum. Auger housing 92 and auger 94 are disposed within drum 16 along the axis of rotation thereof. Shaft 96 of auger 94 extends through rearward end wall 20 of drum 16 and has the first gear (not shown) of the drive system attached thereto such that actuation of motor 40 imparts rotation to auger 94. As seen in FIG. 4, housing 92 has an opening in the upper rearward portion thereof for receiving the mixed feed, as described hereinafter. Also, the forward end of auger 94 and auger housing 92 extend forwardly of forward end wall 18 of drum 16 such that the mixed feed falls through discharge opening 76 into discharge chute 78 when door 80 is open. If door 80 is closed, the feed falls back into drum 16 for further mixing.

A plurality of rows of mixing paddles 98 are mounted on the interior of side walls 22 of drum 16. Each row extends along one of wall panels 24 with the paddles of one row being longitudinally staggered or offset with respect to the paddles in adjacent rows. The longitudinal axis of the paddles are offset with respect to the axis of rotation of drum 16. Preferably, each paddle 98 is L-shaped in cross section and includes a first leg 100 attached to side wall 22 and a second leg 102 extending into the interior of drum 16.

Figure 3:
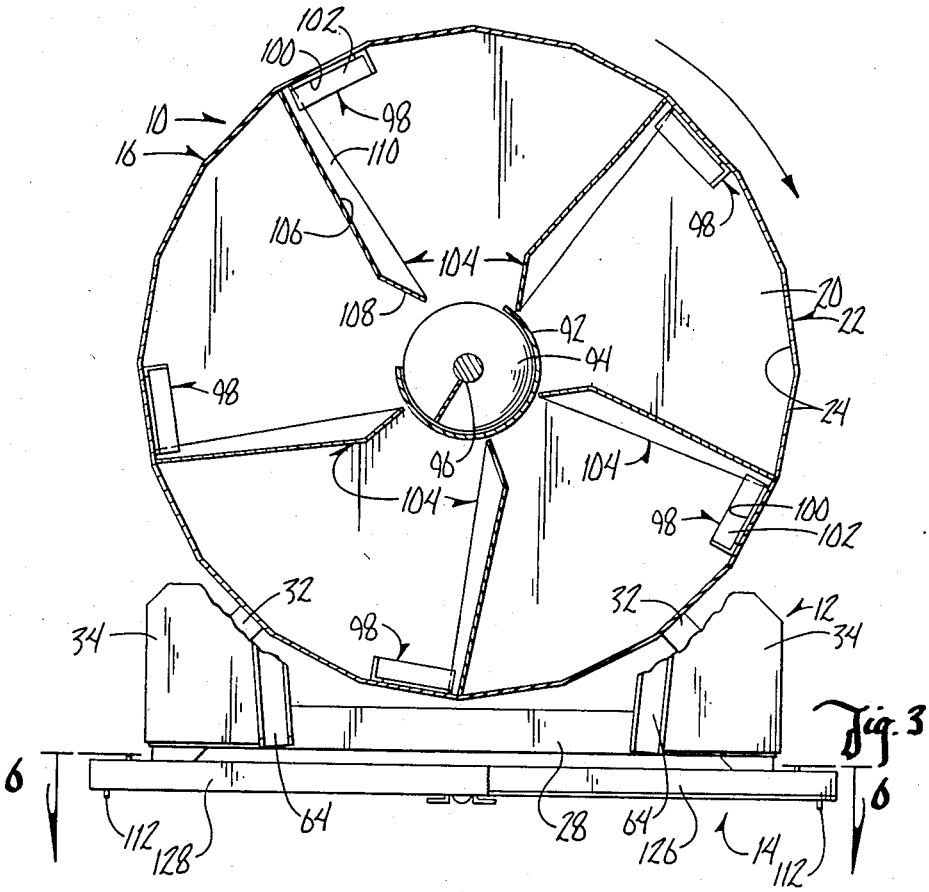
FIG. 3 is a sectional end elevation view taken along lines 3—3 of FIG. 2.

A plurality of channel-shaped scoop blades 104 are mounted upon rearward end wall 20 of drum 16. Each scoop blade 104 includes a first floor member 106 extending inwardly from side wall 22 of drum 16, a second floor member 108 extending from the inner end of floor member 106 to a point in close proximity with auger housing 92, and opposite side wall members 110, one of which is secured to rearward end wall 20 of drum 16. Thus, as seen in FIG. 3, each scoop blade is somewhat concave in cross section.

Figure 7:
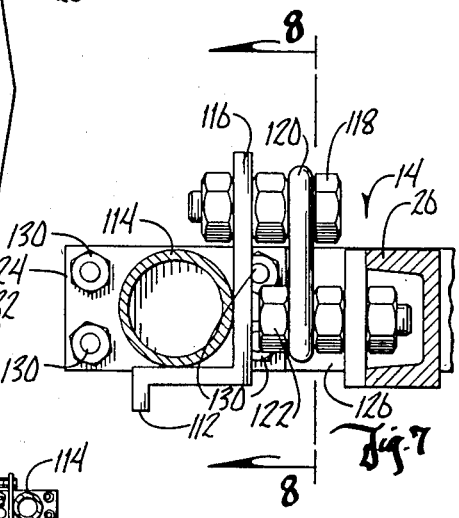
FIG. 7 is an enlarged view taken along lines 7—7 of FIG. 6.
Figure 6:
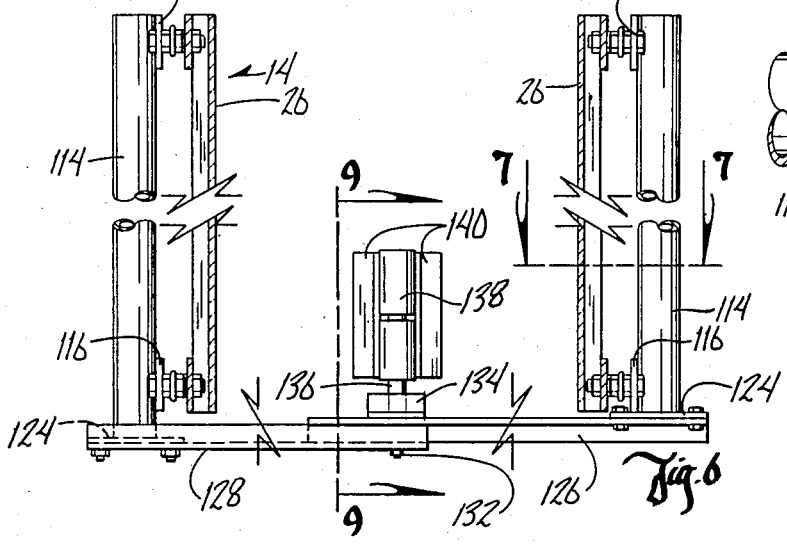
FIG. 6 is a view of the frame and sub-frame taken along lines 6—6 of FIG. 3.
Figure 8:
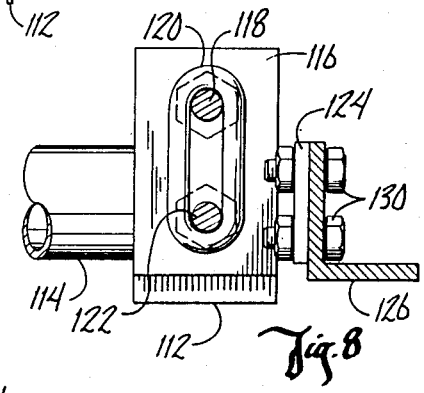
FIG. 8 is a view taken along lines 8—8 of FIG. 7.

FIGS. 6–9 show the suspension of frame 12 upon subframe 14. More particularly, sub-frame 14 includes four corner legs 112 and opposite connecting members 114 which interconnect the forward legs with the rearward legs on the respective sides of device 10. Each leg 112 includes an upwardly extending support arm 116. A first support pin 118, such as a bolt, extends through support arm 116 and has a hanging means 120 freely suspended therefrom. A second support pin 122 extends through hanging means 120 and through side frame member 26 of frame 12. Thus, as best seen in FIG. 7, side frame members 26 are suspended from support arm 116 of legs 112 by hanging means 120. While hanging means 120 is shown to be an elongated ring, it is understood that the hanging means may be of any suitable shape and construction, such as a steel plate with holes for support pins 118 and 122.

Figure 9:
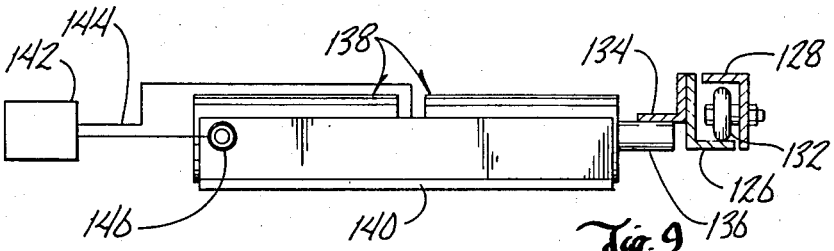
FIG. 9 is an enlarged view taken along lines 9—9 of FIG. 6.

Each side connecting member 114 of sub-frame 14 has a plate member 124 integrally connected to the forward end thereof. A pair of elongated bars 126, 128 are connected to the opposite plate members 124 by fastening means 130. Bars 126 and 128 are L-shaped in cross-section and extend inwardly towards one another such that their inner ends overlap. A roller wheel 132 is secured to the inner end of bar 128 and engages bar 126, as shown in FIG. 9. An L-shaped member 134 is attached to the rearward side of bar 126 by welding or the like adjacent the inner end thereof. Member 134 engages an extension post 136 of a strain gauge 138. Strain gauge 138 is mounted in a framework 140 which itself may be connected to sub-frame 14. Strain gauge 138 is in electrical communication with a readout means 142 via electrical wires 144. An electric ground 146 is also provided on framework 140.

As grain is loaded into drum 16, the increased weight therein tends to bow support arms 116 of legs 112 on each side of device 10 inwardly toward one another. The rigid side connecting members 114 of sub-frame 14 insures that the weight within drum 16 is distributed evenly on legs 112. As support arms 116 on the forward legs bow inwardly under the weight of the loaded drum, bars 126 and 128 are displaced downwardly accordingly. Thus, a small degree of displacement at the outer ends of bars 126 and 128 produces a correspondingly greater displacement at the inner ends thereof due to the length of the bars. Such displacement of the inner ends of bars 126 and 128 is sensed by extension post 136 of strain gauge 138 due to engagement of L-shaped member 134 with the extension post. Readout means 142 converts the displacement of bars 126 and 128 as sensed by strain gauge 138 to a force corresponding to the weight of the feed within drum 16. Thus, the suspension of frame 12 by sub-frame 14 interacts with strain gauge 138 and readout means 142 to provide an accurate scale for weighing the feed.

In operation, drum 16 and auger 94 are rotated about their co-extensive axes of rotation by actuation of motor 40. As various feed components are introduced into the forward end of drum 16 through hopper 72, the feed is picked up from the low area of drum 16 by legs 102 of paddles 98 and carried upwardly along the path of rotation of drum 16 until the feed falls from the paddles back into the lower area of the drum. Also, the feed is conveyed rearwardly as it is carried by paddles 98 due to the angular disposition of the longitudinal axis of the paddles with respect to the axis of rotation of the drum.

Furthermore, the polygonal shape of side wall 22 of drum 16 facilitates the carrying of the grain upwardly along the path of rotation of the drum so as to enhance mixing of the feed. Thus, the feed is repeatedly picked up and carried by side wall panels 24 and paddles 98 and dropped into the lower portion of the drum for complete and efficient mixing as it is conveyed rearwardly by the paddles.

When the mixed feed reaches rearward end wall 20 of drum 16, each scoop blade 104 scoop up a quantity of feed and carries it upwardly along the path of rotation until the feed falls by gravity from the scoop blade into auger housing 92 through the opening therein adjacent rearward end wall 20 of drum 16 for conveyance by auger 94 to the forward end of the drum. When the feed reaches the forward end, all, part or none of the feed passes through discharge opening 76, depending on the position of door 80, for removal from device 10. Any feed which is not removed from device 10 falls back into drum 16 for further mixing.

From the foregoing, it can be seen that at least all of the stated objectives are accomplished by feed mixing device 10 of the present invention.

What is claimed is:

1. A feed mixing device, comprising:

a frame;

a drum rotatably mounted on said frame and having a plurality of elongated planar wall segments forming a polygonally shaped side wall and opposite forward and rearward end walls;

means on said frame for rotating said drum;

inlet means on said drum for introducing feed to be mixed into said drum;

discharge means on said drum for removing mixed feed therefrom and, a plurality of rows of elongated mixing paddles secured to the interior of said side wall of said drum, each row extending substantially along the length of one of said planar wall segments with the longitudinal axis of said paddles being angularly disposed with respect to the longitudinal axis of said wall segments such that said paddles move the feed from said inlet means to the opposite end of said drum, and with each row of paddles being longitudinally offset with respect to each adjacent row of paddles.

2. The device of claim 1 further comprising scoop means mounted in said drum opposite said inlet means for conveying said mixed feed to said discharge means.

3. The device of claim 2 wherein said scoop means includes a plurality of elongated scoop blades radially secured to said rearward end wall of said drum.

4. The device of claim 2 wherein said scoop blades have inner and outer ends, said inner ends being angularly disposed with respect to said outer end.

5. The device of claim 1 further including scale means operatively connected to said drum for weighing said feed.

6. The device of claim 5 wherein said frame is suspended on a sub-frame such that a portion of the sub-frame is displaced in response to loading of said drum with said feed and said scale means includes a single strain gauge for sensing the displacement of said portion of said sub-frame, said strain gauge being operatively connected to a readout means.

7. The device of claim 1 wherein each of said paddles is L-shaped in cross-section and has a first leg secured to said side wall of said drum and a second leg extending inwardly therefrom for carrying and conveying said feed during rotation of said drum.

8. The device of claim 3 wherein said scoop blades are channel-shaped in cross-section.

9. The device of claim 1 wherein said mixing paddles extend substantially across the width of said wall segment.

10. A feed mixing device, comprising:

a sub-frame;

a frame suspended from said sub-frame;

a drum rotatably mounted on said frame and having a side wall and opposite forward and rearward ends;

means on said frame for rotating said drum;

inlet means on said drum for introducing feed to be mixed into said drum;

discharge means on said drum for removing mixed feed therefrom; and scale means operatively connected to said drum and to a readout means for continuously and automatically weighing said feed in said drum.

11. The device of claim 10 further comprising a plurality of elongated mixing paddles secured to the interior of said side wall of said drum with the longitudinal axis of said paddles being angularly disposed with respect to the axis of rotational of said drum.

12. The device of claim 10 wherein said scale means includes a strain gauge operatively connected to said drum and to said readout means.

13. The device of claim 12 wherein said sub-frame includes a portion adapted to be deflected in response to loading of said drum with said feed, said deflection being sensed by said strain gauge.

14.The device of claim 12 wherein said sub-frame includes a plurality of legs having lower ends engaging a support surface and upper ends from which said frame is suspended, said upper ends of said legs being adapted to deflect in response to loading of said drum with said feed, and said sub-frame having an arm means connected thereto adjacent said upper end of at least one of said legs and engaging said strain gauge such that said strain gauge senses said deflection.

15. The device of claim 14 wherein said sub-frame further includes a plurality of hanger means each having an upper end connected to the upper end of one of said legs and a lower end spaced above said support surface to which said frame is attached for support thereby.

16. The device of claim 10 wherein said side wall of said drum is polygonally shaped and formed by a plurality of elongated planar wall segments.

17. The device of claim 16 further comprising a plurality of rows of elongated mixing paddles secured to the interior of said side wall of said drum, each row extending substantailly along the length of one of said planar wall segments, with the longitudinal axis of said paddles being angularly disposed with respect to the longitudinal axis of said wall segments such that said paddles move the feed from said inlet means to the opposite end of said drum, and with each row of paddles being longitudinally offset with respect to each adjacent row of paddles.

18. The device of claim 17 wherein each of said paddles is L-shaped in cross-section and has a first leg secured to said planar wall segment and a second leg extending radially inwardly therefrom for carrying and conveying said feed during rotation of said drum.

19. The device of claim 10 further comprising scoop means mounted in said drum opposite said inlet means for conveying said mixed feed to said discharge means.

20. The device of claim 19 wherein said scoop means includes a plurality of elongated scoop blades radially secured to said rearward end wall of said drum.

21. The device of claim 20 wherein said scoop blades have inner and outer ends, said inner ends being angularly disposed with respect to said outer end.

22. The device of claim 20 wherein said scoop blades are channel-shaped in cross-section.

* * * * *